US011462845B2

(12) United States Patent
Lee et al.

(10) Patent No.: US 11,462,845 B2
(45) Date of Patent: Oct. 4, 2022

(54) CONNECTOR ASSEMBLY FOR SOLDERLESS MOUNTING TO A CIRCUIT BOARD

(71) Applicant: 3M INNOVATIVE PROPERTIES COMPANY, St. Paul, MN (US)

(72) Inventors: Kok Hoe Lee, Singapore (SG); Saujit Bandhu, Singapore (SG); Yunlong Qiao, Singapore (SG); Rao L. Vittapalli, Singapore (SG)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 494 days.

(21) Appl. No.: 16/326,457

(22) PCT Filed: Sep. 28, 2017

(86) PCT No.: PCT/IB2017/055968

§ 371 (c)(1),
(2) Date: Feb. 19, 2019

(87) PCT Pub. No.: WO2018/060922

PCT Pub. Date: Apr. 5, 2018

(65) Prior Publication Data

US 2021/0296804 A1 Sep. 23, 2021

Related U.S. Application Data

(60) Provisional application No. 62/401,322, filed on Sep. 29, 2016.

(51) Int. Cl.
*H01R 12/00* (2006.01)
*H01R 12/71* (2011.01)
(Continued)

(52) U.S. Cl.
CPC ..... *H01R 12/714* (2013.01); *H01R 13/2442* (2013.01); *H01R 13/405* (2013.01);
(Continued)

(58) Field of Classification Search
CPC ..... H01R 12/714; H01R 13/2442; H01R 13/405; H01R 13/518; H01R 13/6586; H01R 43/24
(Continued)

(56) References Cited

U.S. PATENT DOCUMENTS 3,586,962 A * 6/1971 Rebstock ..... H02J 7/0048 324/434
4,006,388 A * 2/1977 Bartholomew .... H05K 7/20545 361/691
(Continued)

FOREIGN PATENT DOCUMENTS

WO WO-2004093252 A2 * 10/2004 ..... G01R 1/0466
WO WO 2016-112384 7/2016
WO WO-2018060922 A1 * 4/2018 ..... H01R 12/714

OTHER PUBLICATIONS

International Search report for PCT International Application No. PCT/IB2017/055968 dated Nov. 27, 2017, 4 pages.

*Primary Examiner* — Abdullah A Riyami
*Assistant Examiner* — Vladimir Imas
(74) *Attorney, Agent, or Firm* — Michael J. Stern; Robert S. Moshrefzadeh

(57) ABSTRACT

A connector assembly for mounting on and making solderless electrical contact with a printed circuit board includes a plurality of stacked wafer assemblies. Each wafer assembly includes a wafer, a plurality of terminals partially embedded in the wafer where each terminal includes a connecting portion embedded in the wafer, a resiliently compressible mating portion for making solderless contact with a corresponding conductive pad of a PCB and a contact portion.
(Continued)

The wafer is molded over the terminals. The wafer assembly also includes a plurality of wires terminated in termination regions at the contact portions of the terminals, and a shield disposed in the recess of the wafer and extending across the wafer. The connector assembly further includes a housing molded over the stacked wafers and the termination regions.

19 Claims, 11 Drawing Sheets

(51) Int. Cl.
*H01R 13/24* (2006.01)
*H01R 13/405* (2006.01)
*H01R 13/518* (2006.01)
*H01R 13/6586* (2011.01)
*H01R 43/24* (2006.01)

(52) U.S. Cl.
CPC ..... *H01R 13/518* (2013.01); *H01R 13/6586* (2013.01); *H01R 43/24* (2013.01)

(58) Field of Classification Search
USPC ..... 439/78
See application file for complete search history.

(56) References Cited

U.S. PATENT DOCUMENTS 4,095,867 A * 6/1978 Parks ..... H05K 1/0221 439/329
4,533,187 A * 8/1985 Kirkman ..... H05K 7/1038 439/736
4,591,225 A * 5/1986 Squitieri ..... H01R 12/675 439/404
4,615,578 A * 10/1986 Stadler ..... H01R 12/775 439/607.47
4,619,490 A * 10/1986 Hawkings ..... H01R 13/516 439/166
4,770,639 A * 9/1988 Lau ..... H04Q 1/023 439/61
4,807,088 A * 2/1989 Wistling ..... H01R 12/775 361/818
6,089,920 A * 7/2000 Farnworth ..... H01L 25/0657 439/632
6,409,521 B1 * 6/2002 Rathburn ..... H01R 13/2435 439/66
6,441,315 B1 * 8/2002 Eldridge ..... G01R 1/06727 438/117
6,478,624 B2 11/2002 Ramey
6,776,629 B2 * 8/2004 Shuey ..... H01R 13/6587 439/108
6,825,422 B2 * 11/2004 Eldridge ..... G01R 1/06727 361/776
6,870,381 B2 * 3/2005 Grube ..... H01R 13/447 324/755.07
6,888,362 B2 * 5/2005 Eldridge ..... G01R 1/07342 324/755.07
6,923,681 B1 8/2005 Creighton
6,926,553 B2 * 8/2005 Wu ..... H01R 9/0515 439/497
7,011,530 B2 * 3/2006 Sitaraman ..... H01R 12/52 439/66
7,126,220 B2 * 10/2006 Lahiri ..... G01R 3/00 257/761
7,137,830 B2 * 11/2006 Lahiri ..... H01L 21/4853 438/117
7,244,125 B2 * 7/2007 Brown ..... H01R 12/52 439/74
7,245,137 B2 * 7/2007 Eldridge ..... G01R 1/06727 324/754.14
7,270,573 B2 * 9/2007 Houtz ..... H01R 12/585 439/607.05
7,371,117 B2 * 5/2008 Gailus ..... H01R 12/721 439/607.08
7,578,696 B2 * 8/2009 Yuan ..... H01R 13/447 439/485
7,675,301 B2 * 3/2010 Eldridge ..... G01R 1/06727 324/755.05
7,989,945 B2 * 8/2011 Williams ..... H01R 13/03 438/117
8,025,507 B2 * 9/2011 Kim ..... H01R 12/7064 439/79
8,182,289 B2 * 5/2012 Stokoe ..... H01R 12/721 439/607.11
8,272,877 B2 * 9/2012 Stokoe ..... H01R 12/721 439/55
8,485,831 B2 * 7/2013 Cipolla ..... H01R 13/6587 439/74
8,491,313 B2 * 7/2013 McNamara ..... H01R 13/6461 439/59
9,030,222 B2 * 5/2015 Eldridge ..... G01R 1/06711 324/755.05
9,142,921 B2 * 9/2015 Wanha ..... H01R 13/6473
9,666,965 B2 * 5/2017 Liu ..... H01R 12/585
9,863,978 B2 * 1/2018 Bohm ..... H01R 12/91
9,905,975 B2 * 2/2018 Cartier, Jr. ..... H01R 13/6587
10,122,129 B2 * 11/2018 Milbrand, Jr. ..... H01R 12/75
10,522,931 B2 * 12/2019 Avery ..... H01R 13/518
10,739,828 B2 * 8/2020 Reed ..... H01R 13/6583
11,070,006 B2 * 7/2021 Gailus ..... H05K 1/0245
11,088,480 B2 * 8/2021 Avery ..... H01R 13/405
2002/0055282 A1 * 5/2002 Eldridge ..... G01R 1/0483 257/E23.078
2002/0123252 A1 * 9/2002 Zhou ..... H01R 13/2407 439/66
2003/0015347 A1 * 1/2003 Eldridge ..... H01R 13/2407 174/260
2003/0214045 A1 * 11/2003 Lahiri ..... H01L 21/4853 257/761
2003/0218244 A1 * 11/2003 Lahiri ..... B81B 3/0072 257/734
2003/0232527 A1 * 12/2003 Shuey ..... H01R 13/6586 439/108
2004/0022040 A1 * 2/2004 Sitaraman ..... H01R 12/52 361/772
2004/0177499 A1 * 9/2004 Eldridge ..... H01R 4/26 29/831
2004/0196061 A1 * 10/2004 Hoppe ..... G11C 29/56016 257/E23.179
2004/0259420 A1 * 12/2004 Wu ..... H01R 9/0515 439/607.05
2004/0266234 A1 * 12/2004 Grube ..... H01R 13/447 439/148
2005/0124181 A1 * 6/2005 Brown ..... H05K 3/4092 257/E23.078
2005/0189956 A1 * 9/2005 Eldridge ..... H01R 12/52 324/754.07
2005/0266728 A1 * 12/2005 Houtz ..... H01R 13/112 439/607.39
2007/0144841 A1 * 6/2007 Chong ..... H01L 23/49811 188/266.7
2007/0269997 A1 * 11/2007 Eldridge ..... H01R 13/2407 324/754.08
2007/0275572 A1 * 11/2007 Williams ..... H01R 12/52 257/E23.078
2008/0012173 A1 1/2008 Asao
2009/0189624 A1 * 7/2009 Oh ..... H01R 12/714 324/754.07
2010/0134126 A1 * 6/2010 Hong ..... H01R 12/526 438/666
2010/0255694 A1 * 10/2010 Kim ..... H01R 12/7064 439/78
2010/0323551 A1 * 12/2010 Eldridge ..... H01R 13/2442 439/387
2011/0076894 A1 * 3/2011 Hsu ..... H01R 13/2442 439/660
2011/0212632 A1 * 9/2011 Stokoe ..... H01R 12/721 439/83

(56) References Cited

U.S. PATENT DOCUMENTS

| | | | | |
|---|---|---|---|---|
| 2011/0212649 | A1* | 9/2011 | Stokoe | H01R 12/721 439/626 |
| 2011/0212650 | A1* | 9/2011 | Amleshi | H01R 12/724 439/660 |
| 2014/0199885 | A1* | 7/2014 | Vinther | H01R 43/00 439/578 |
| 2014/0308852 | A1* | 10/2014 | Gulla | H01R 12/91 439/625 |
| 2015/0079845 | A1 | 3/2015 | Wanha | |
| 2016/0197423 | A1* | 7/2016 | Regnier | H01R 12/714 439/59 |
| 2018/0006416 | A1* | 1/2018 | Lloyd | H05K 7/1487 |
| 2018/0120906 | A1* | 5/2018 | Reed | H01R 24/60 |
| 2019/0036263 | A1* | 1/2019 | Avery | H01R 13/405 |
| 2020/0194913 | A1* | 6/2020 | Avery | H01R 12/737 |
| 2021/0126404 | A1* | 4/2021 | Laurx | H01R 13/40 |
| 2021/0296804 | A1* | 9/2021 | Lee | H01R 13/6586 |

* cited by examiner

CONNECTOR ASSEMBLY FOR SOLDERLESS MOUNTING TO A CIRCUIT BOARD

TECHNICAL FIELD

This application relates to electrical connectors and electrical connector assemblies.

BACKGROUND

Electrical connectors are electro-mechanical devices typically including some type of mechanical housing supporting and/or partially enclosing electrical terminals. Electrical connectors are frequently used to electrically interconnect two or more electronic components. Some electrical connectors provide electrical interconnection between an electrical cable assembly including one or more electrical wires and a printed circuit board (PCB). Typically a wire-to-board interconnect includes a connector pair comprising a plug connector and a receptacle connector in the mated position. Either the plug connector or the receptacle connector of the connector pair is mounted onto a printed circuit board while the corresponding mating connector from the same pair forms a part of a cable assembly.

BRIEF SUMMARY

According to some embodiments, a connector assembly for mounting on and making solderless electrical contact with a printed circuit board includes a plurality of stacked wafer assemblies. Each wafer assembly includes a wafer, a plurality of terminals partially embedded in the wafer where each terminal includes a connecting portion embedded in the wafer, a resiliently compressible mating portion for making solderless contact with a corresponding conductive pad of a PCB and a contact portion. The wafer is molded over the terminals. The wafer assembly also includes a plurality of wires terminated in termination regions at the contact portions of the terminals, and a shield disposed in the recess of the wafer and extending across the wafer. The connector assembly further includes a housing molded over the stacked wafers and the termination regions.

Some embodiments are directed to a method of making a connector assembly for mounting on and making solderless electrical contact with a printed circuit board (PCB) along a mounting direction. The method includes making a plurality of wafer assemblies. Making a wafer assembly includes providing a row of spaced apart substantially parallel terminals, each terminal comprising: a mating portion, a contact portion, and a connecting portion disposed between the mating portion and the contact portion. The mating portion extends from a first end of the connecting portion along the mounting direction for making solderless contact with a corresponding conductive pad of a PCB. The mating portion is resiliently compressible in the mounting direction. The contact portion extends from an opposite second end of the connecting portion along the mounting direction. The method includes molding a wafer over the connecting portions of the plurality of the terminals. The wafer has a width along the mounting direction and a length along the row direction of the terminals. Wires are terminated in termination regions at respective contact portions of corresponding terminals. A shield is disposed adjacent a major surface of the wafer. The shield extends substantially along the entire width and length of the wafer. The wafers in the plurality of wafer assemblies are stacked such that for each pair of adjacent wafers, the shield corresponding to one of the wafers is disposed between the wafers. At least the stacked wafers and the termination regions of the plurality of wires are enclosed in a housing.

These and other aspects of the present application will be apparent from the detailed description below. In no event, however, should the above summaries be construed as limitations on the claimed subject matter, which subject matter is defined solely by the attached claims.

BRIEF DESCRIPTION OF THE DRAWINGS

The figures are not necessarily to scale. Like numbers used in the figures refer to like components. However, it will be understood that the use of a number to refer to a component in a given figure is not intended to limit the component in another figure labeled with the same number.

DESCRIPTION OF ILLUSTRATIVE EMBODIMENTS

Embodiments disclosed herein involve connector assemblies that can function to transfer electrical signals to and from at least two individual circuit boards. A connector assembly comprises at least one wafer assembly with a plurality of contacts having spring features for electrical connection between a corresponding circuit board and the connector assembly. In some embodiments, the connector assembly may be mechanically mounted onto the circuit board, e.g., by fasteners and/or latches.

Typically a cable-to-circuit board interconnect consists of a plug and receptacle connector pair. Either the plug or receptacle of the connector-pair is mounted onto a printed circuit board (PCB) while the corresponding mating connector from the same pair forms a part of a connector assembly. Electronic market segments are currently moving towards miniaturization, at least in part for the purpose of space and cost optimization. Consistent with this trend, it is desirable for the form factor of electrical connector assemblies to be reduced. As shown in the embodiments discussed herein, reducing the form factor of electrical connector assemblies may include reducing the size of the individual plug/receptacle pair and may also involve simplifying the interconnect system as well.

In addition to miniaturization and simplification of the connector pair, it is also desirable to revise the manufacturing process to reduce manufacturing costs. The manufacturing process can include making the connector assembly and/or installation or mounting of the connector assembly to the circuit board.

Embodiments disclosed herein can reduce the cost and size of connector assemblies. To address the size reduction, the plug and receptacle of a typical connector pair is unified and simplified to form one individual connector that connects electrical signals from an electrical cable to a circuit board. Embodiments discussed below remove the plug/receptacle mating interface that causes electrical losses. A solderless, pressure-induced installation of the individual connector assembly onto the corresponding circuit board eliminates soldering and therefore reduces not only materials cost but also the production cycle time yielding an enhanced manufacturing process.

Figure 1:
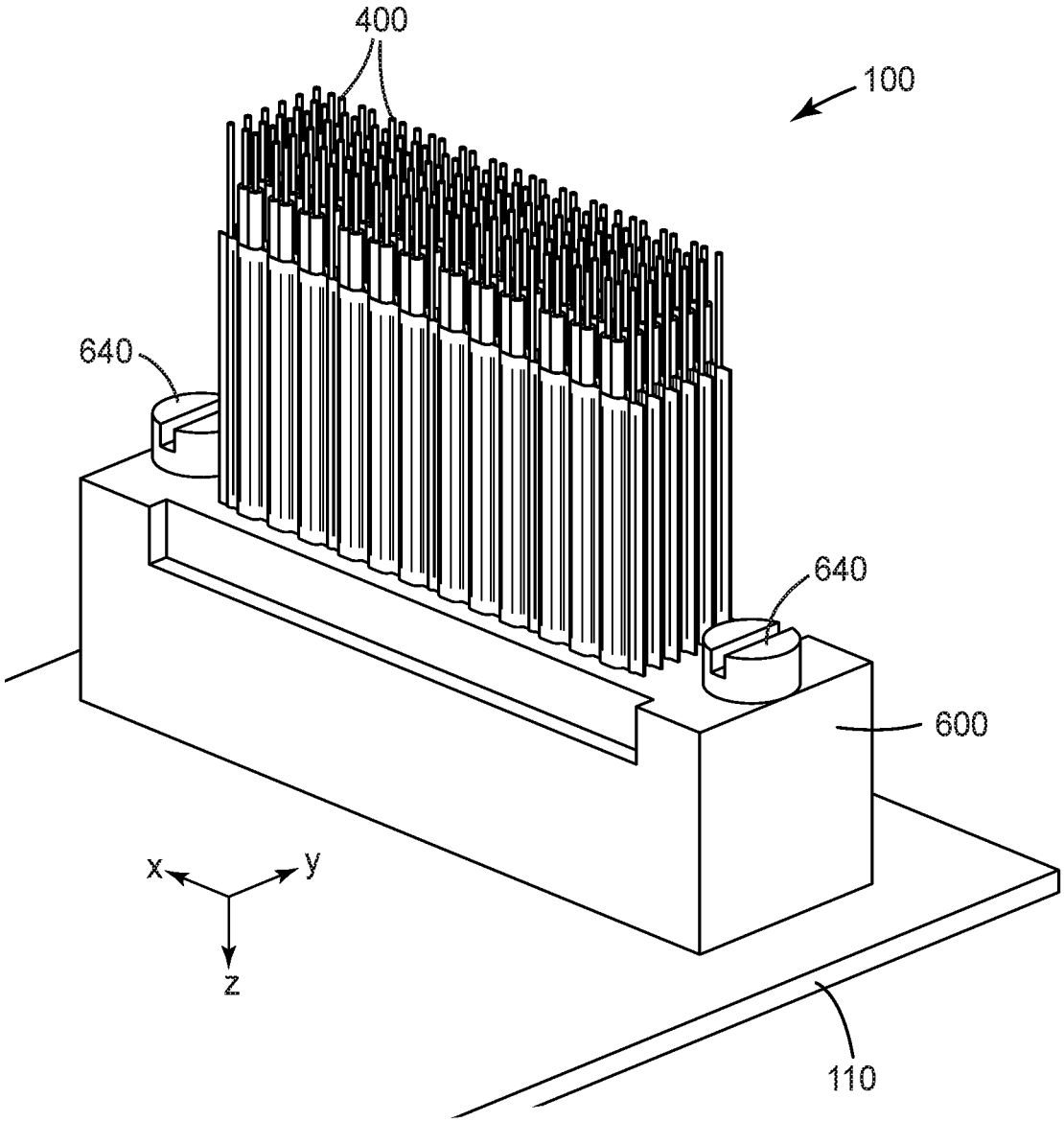
FIG. 1 is a perspective view of a connector assembly and circuit board in accordance with some embodiments.
Figure 2:
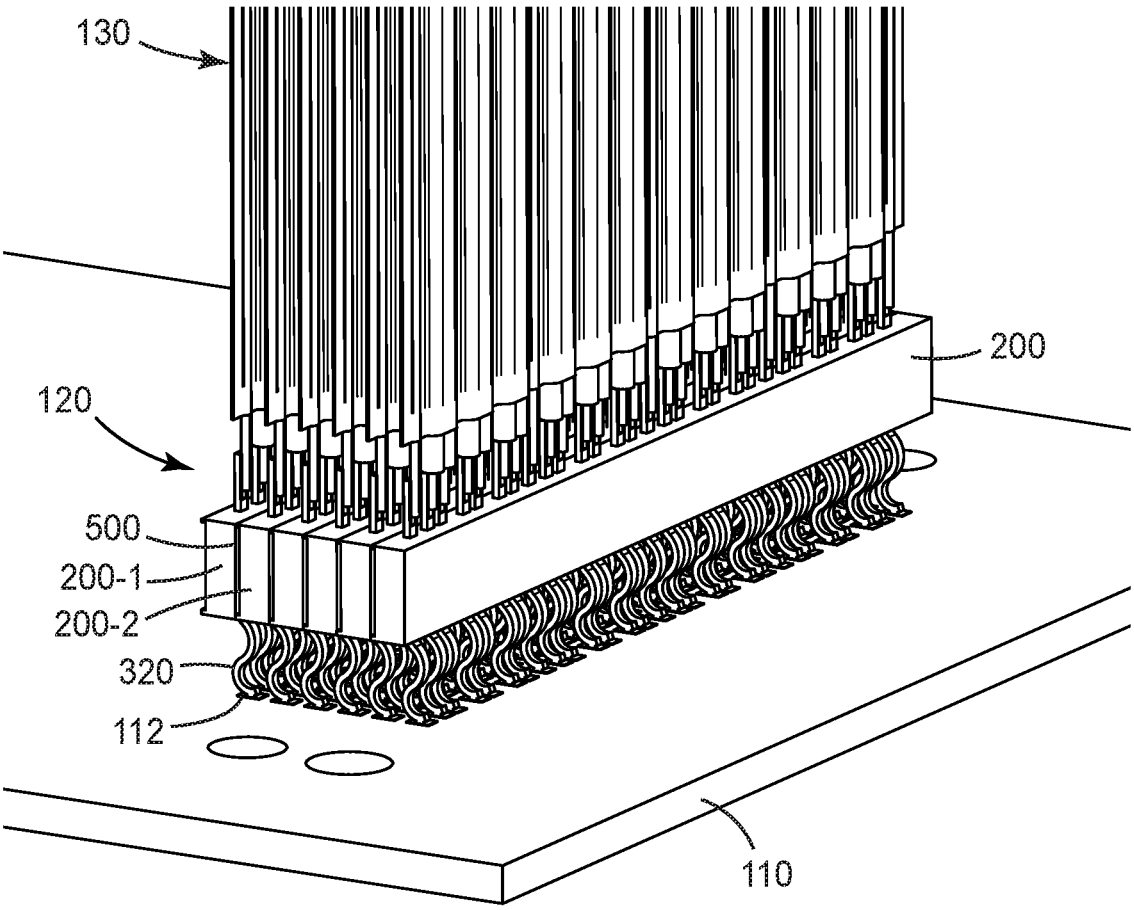
FIG. 2 shows a perspective view of a stack of wafer assemblies mounted on a circuit board according to some embodiments.

FIGS. 1 through 16 illustrate features of an electrical connector assembly 100 configured for solderless mounting to a circuit board 110 according to various example embodiments. FIG. 1 shows a connector assembly 100 configured for mounting on and making solderless electrical contact with a printed circuit board (PCB) 110 along a mounting direction (z). As shown in FIGS. 1 and 2, the connector assembly 100 includes a stack 120 of wafer assemblies 130.

Figure 3:
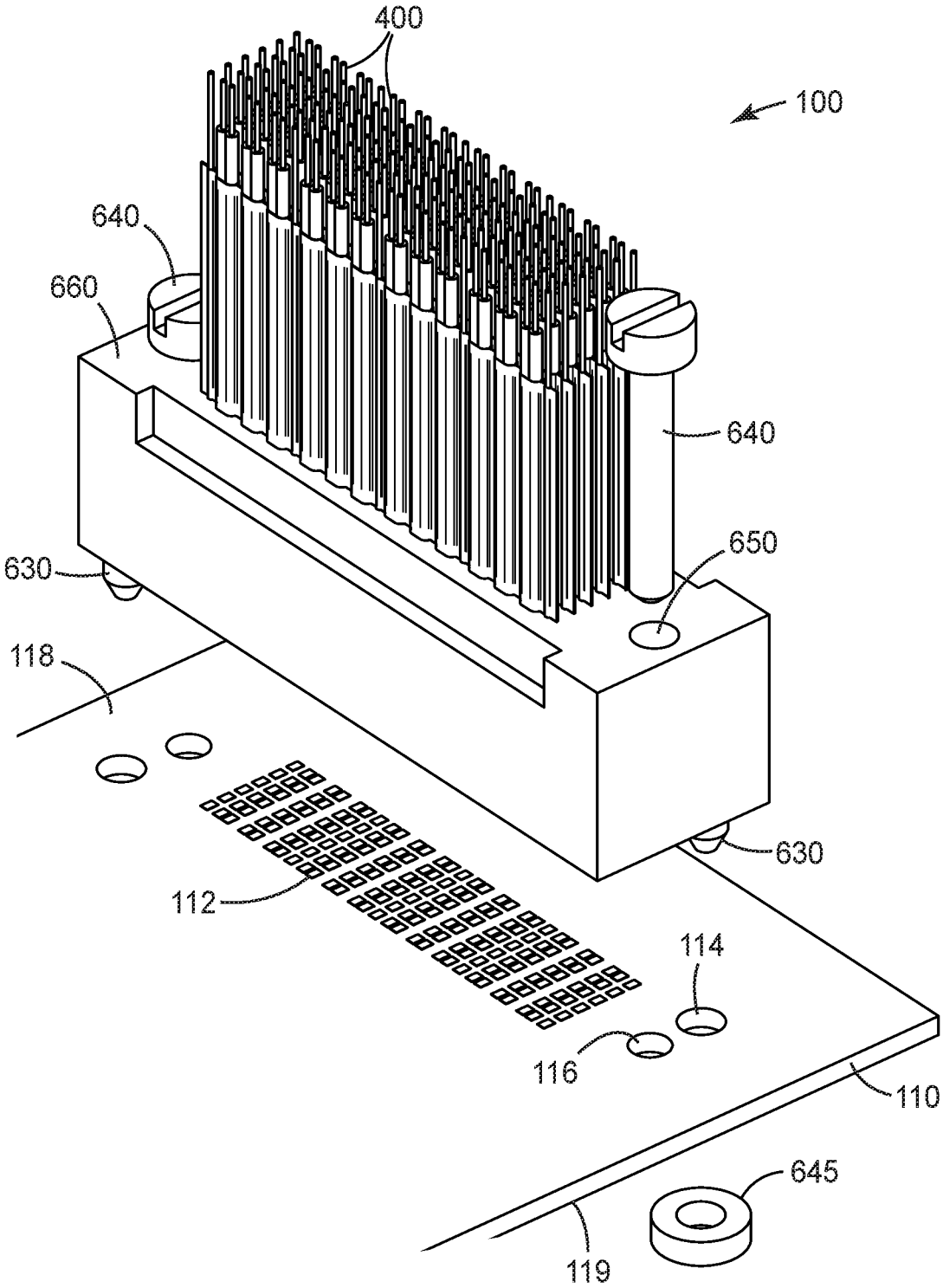
FIG. 3 is a perspective view of the connector assembly of FIG. 1 over the circuit board of FIG. 1.
Figure 4:
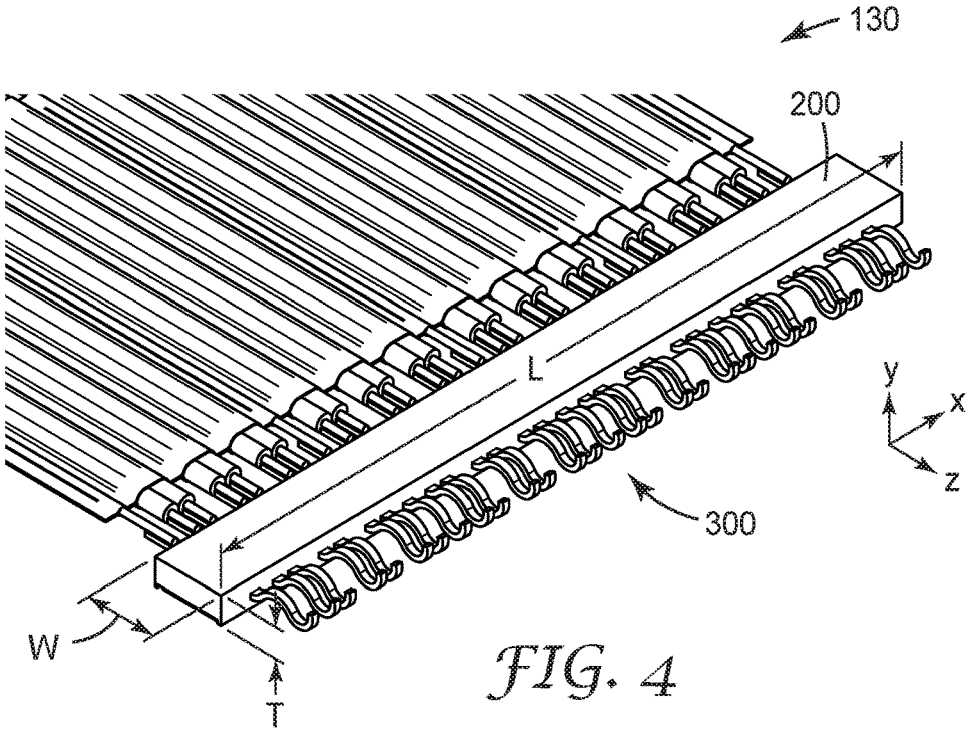
FIG. 4 is a perspective view of a connector assembly according to some embodiments.
Figure 5:
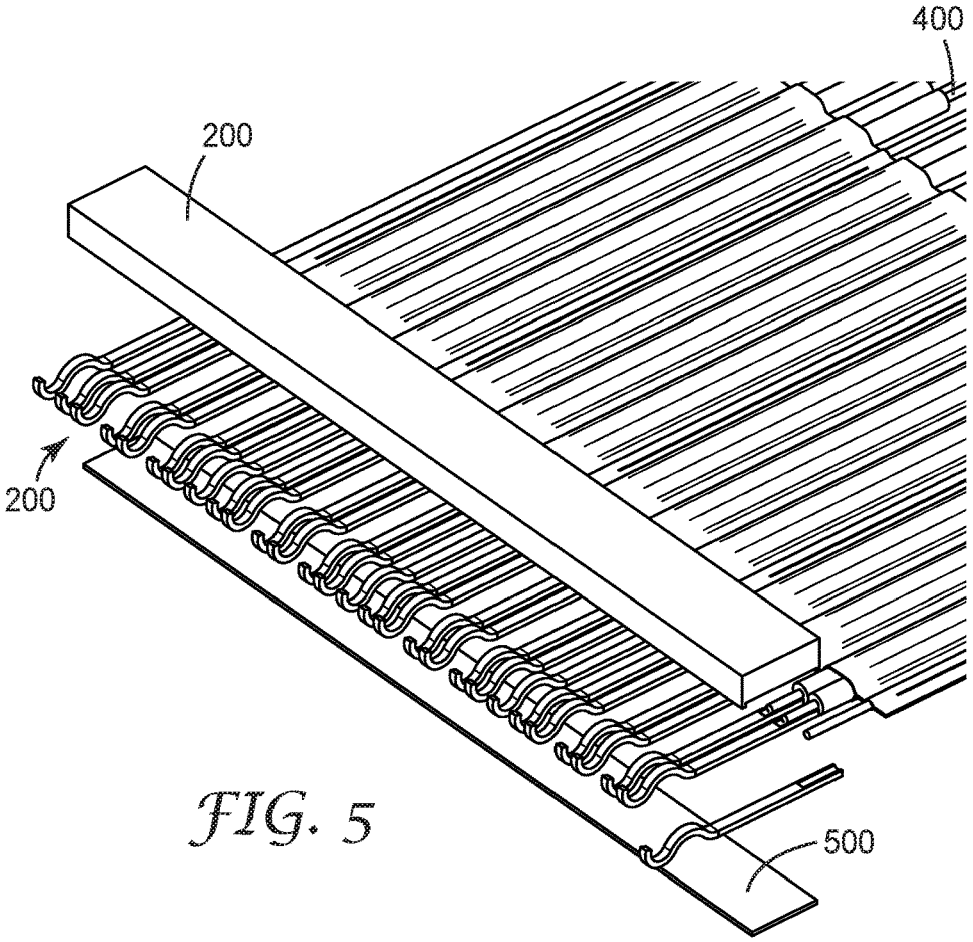
FIG. 5 shows an exploded perspective view of one side of the connector assembly of FIG. 4.
Figure 6:
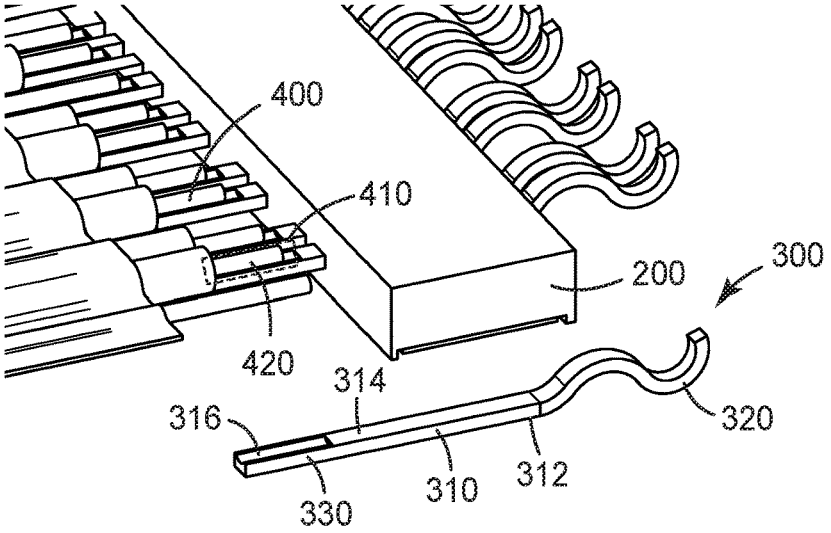
FIG. 6 illustrates the terminals and termination region of the connector assembly of FIG. 4.

As best seen in FIGS. 4-6, a wafer assembly 130 includes a row of spaced apart substantially parallel terminals 300. With reference to FIG. 6, each terminal 300 comprises a mating portion 320, a contact portion 330, and a connecting portion 310 disposed between the mating portion 320 and the contact portion 330. The mating portion 320 extends from a first end 312 of the connecting portion 310 along the mounting direction (z) for making solderless contact with a corresponding conductive pad 112 of a PCB 110, which is shown in FIGS. 2 and 3. The mating portion 320 is resiliently compressible in the mounting direction. As shown in FIG. 6, in some embodiments at least a portion of the mating portion 320 of each terminal 300 is s-shaped. The contact portion 330 extends from an opposite second end 314 of the connecting portion 310 along the mounting direction. According to some embodiments, the contact portion 330 of each terminal 300 defines a groove 316 configured to receive an end 420 of a corresponding wire 400.

The wafer assembly 130 includes a wafer 200 (see FIG. 2, and FIGS. 4-7) molded over and enclosing the connecting portions of the row of terminals 300. As shown in FIG. 4, each wafer 200 has a width (W) along the mounting direction (z) and a length (L) along the row direction (x) of terminals 300. Each wafer 200 has a thickness (T) along a thickness direction (y) perpendicular to the row and mounting directions. The thickness is substantially less than the width, and the width substantially less than the length.

Figure 11:
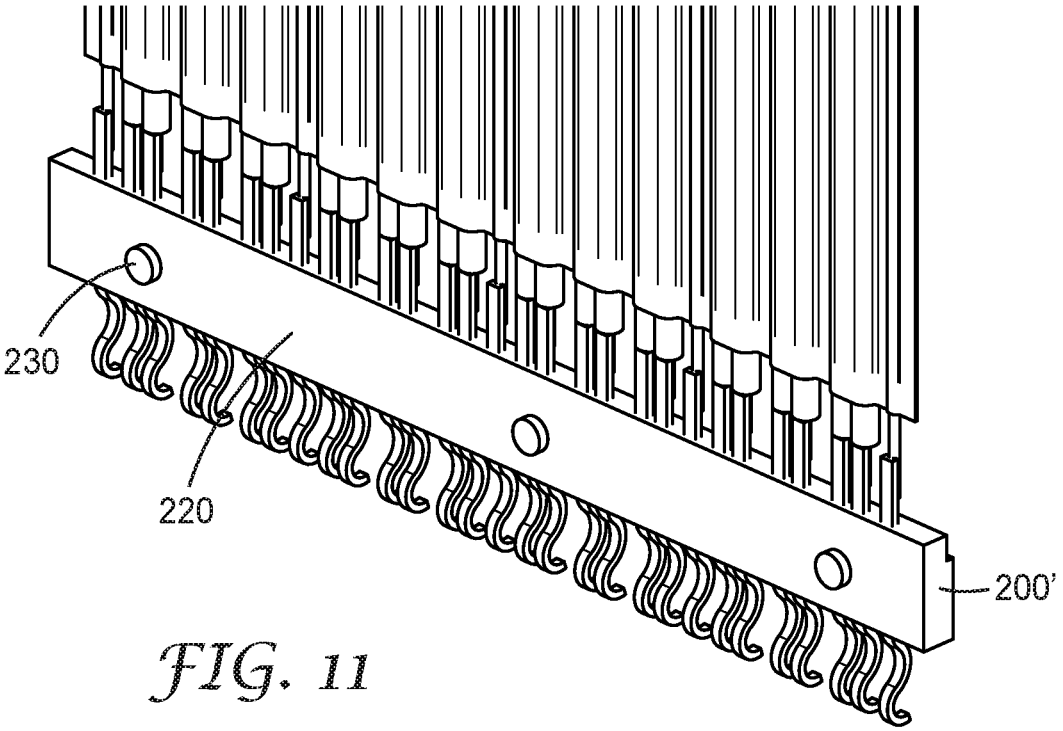
FIG. 11 is a perspective view of one side of a wafer assembly in accordance with some embodiments.
Figure 12:
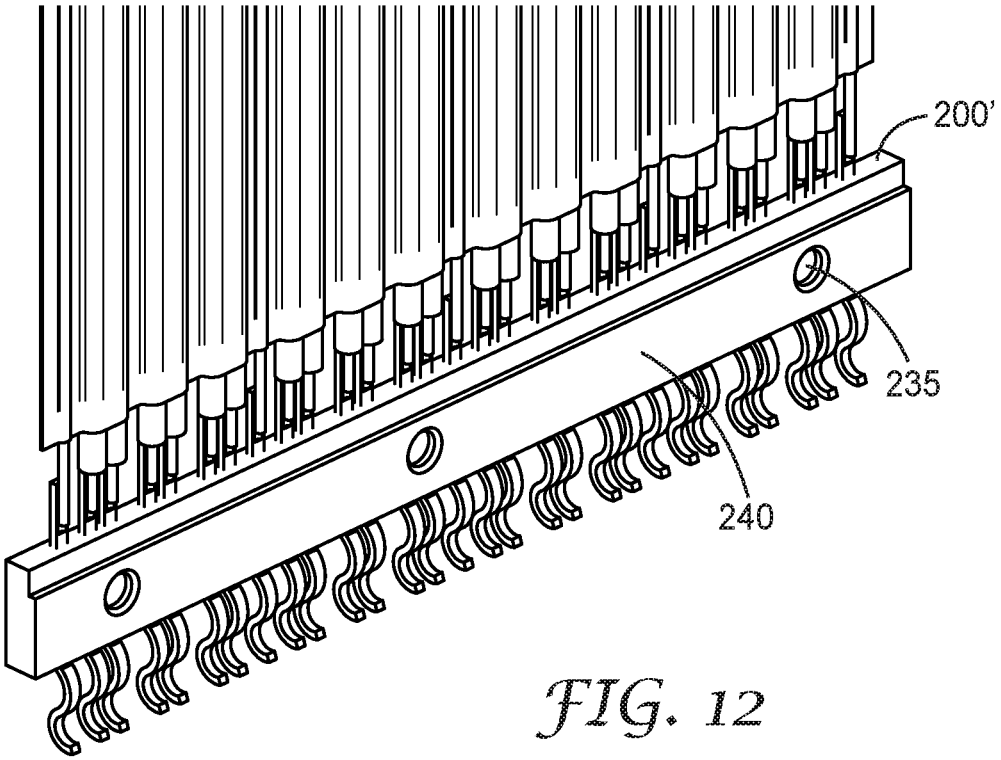
FIG. 12 is a is a perspective view of another side of the wafer assembly of FIG. 11.

Referring now to FIGS. 11 and 12, according to some embodiments, each wafer 200' comprises at least one first locking feature 230 on a first major surface 220 of the wafer 200' and at least one second locking feature 235 on an opposite second major surface 240 of the wafer 200'. For each pair of adjacent wafers 200' in the stacked wafers, the at least one first locking feature 230 of one of the wafers engages the at least one second locking feature 235 of the other one of the wafers to secure the wafers to one another. For example, each first locking feature 230 may be a protrusion and each second locking feature 235 may be a recess.

The wafer assembly 130 includes a plurality of wires 400, shown in FIGS. 1, 3, 5, 6, 7, and 9. As shown in FIG. 6, each wire 400 is terminated in a termination region 410 at the contact portion 330 of a corresponding terminal 300. In some embodiments, for each wafer assembly 130, the wafer 200 may be molded over and enclose the termination regions 410 of the plurality of wires 400.

Figure 7:
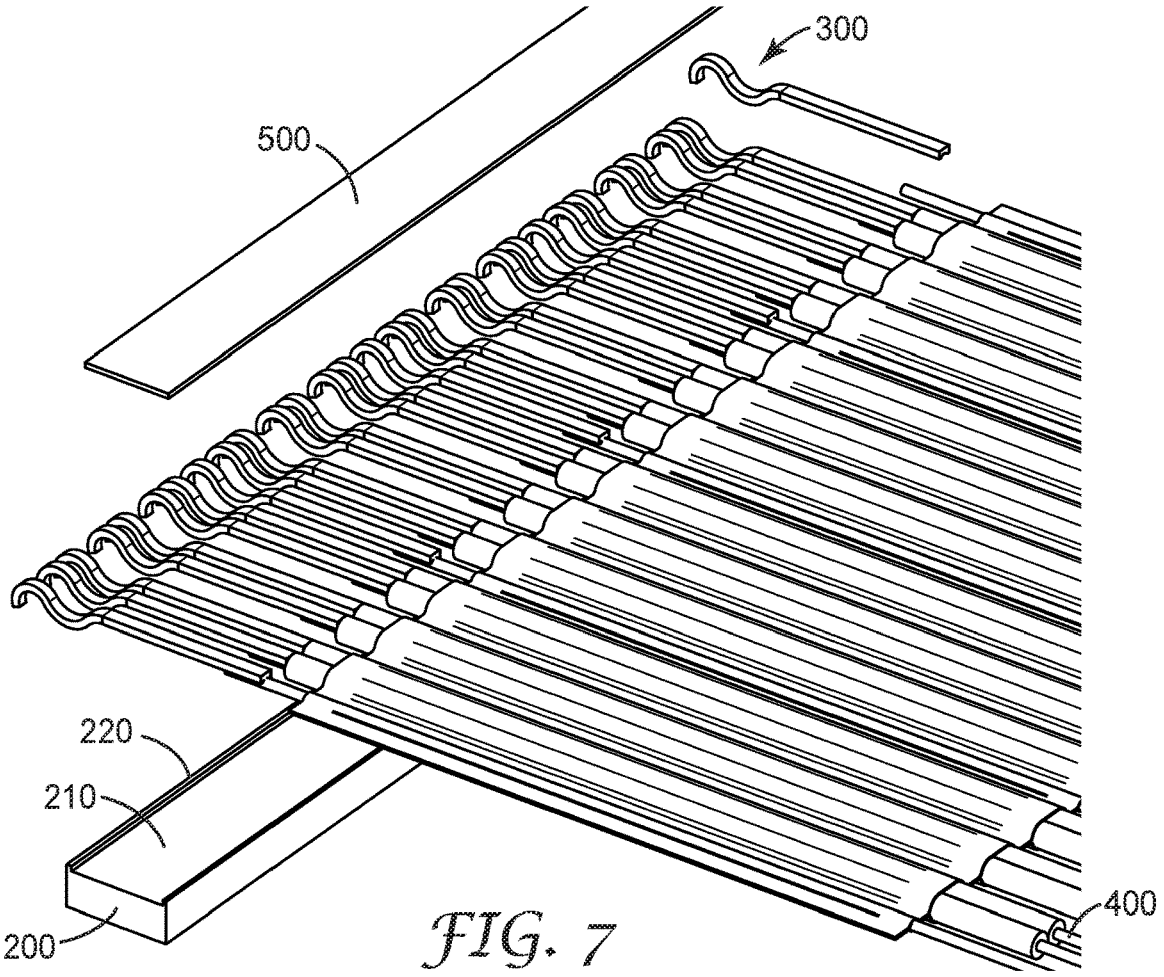
FIG. 7 shows an exploded perspective view of another side of the connector assembly of FIG. 4.

The wafer assembly 130 may also include a shield 500 disposed adjacent a major surface 220 of the wafer 200 and extending substantially along the entire width and length of the wafer 200 as illustrated in FIGS. 5 and 7. For example, the shield 500 of each wafer assembly 130 may be a rectangular plate. As best seen in FIG. 2, wafers 200 in the stack of wafer assemblies 130 are stacked so that for each pair of adjacent wafers 200-1, 200-2, the shield 500 corresponding to one of the wafers 200-1 is disposed between the adjacent wafers 200-1, 200-2. In some implementations, shown in FIG. 7, for each wafer assembly 130, the wafer 200 defines a recess 210 in a major surface 220 of the wafer 200 and the shield 500 is disposed in the recess 210.

Figure 10:
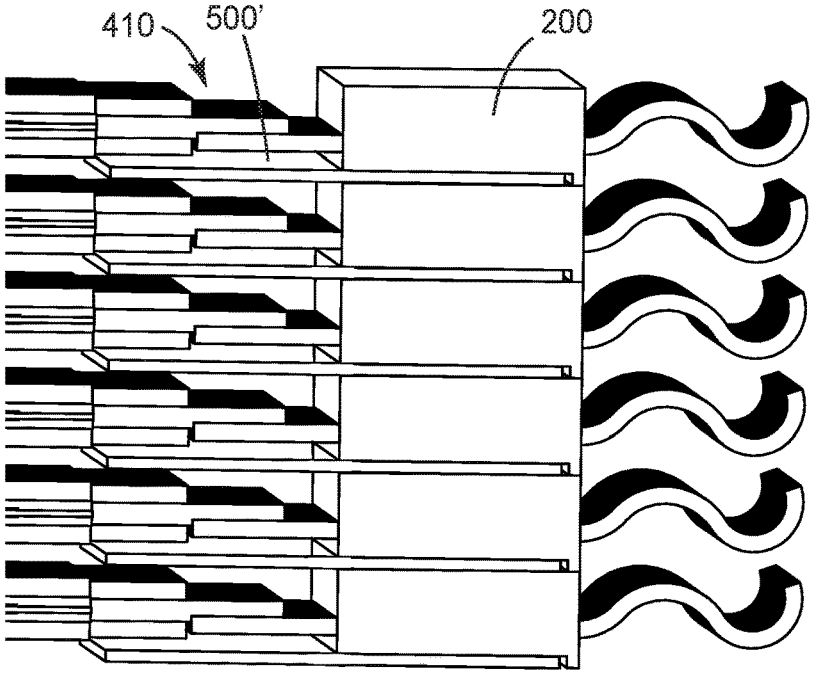
FIG. 10 illustrates an extended shield in accordance with some embodiments.

According to some embodiments, as shown in FIG. 10, an extended shield 500' extends beyond the wafer 200 toward the termination region 410 so that in a plan view, the extended shield 500' covers at least a portion of the termination region 410.

Figure 15:
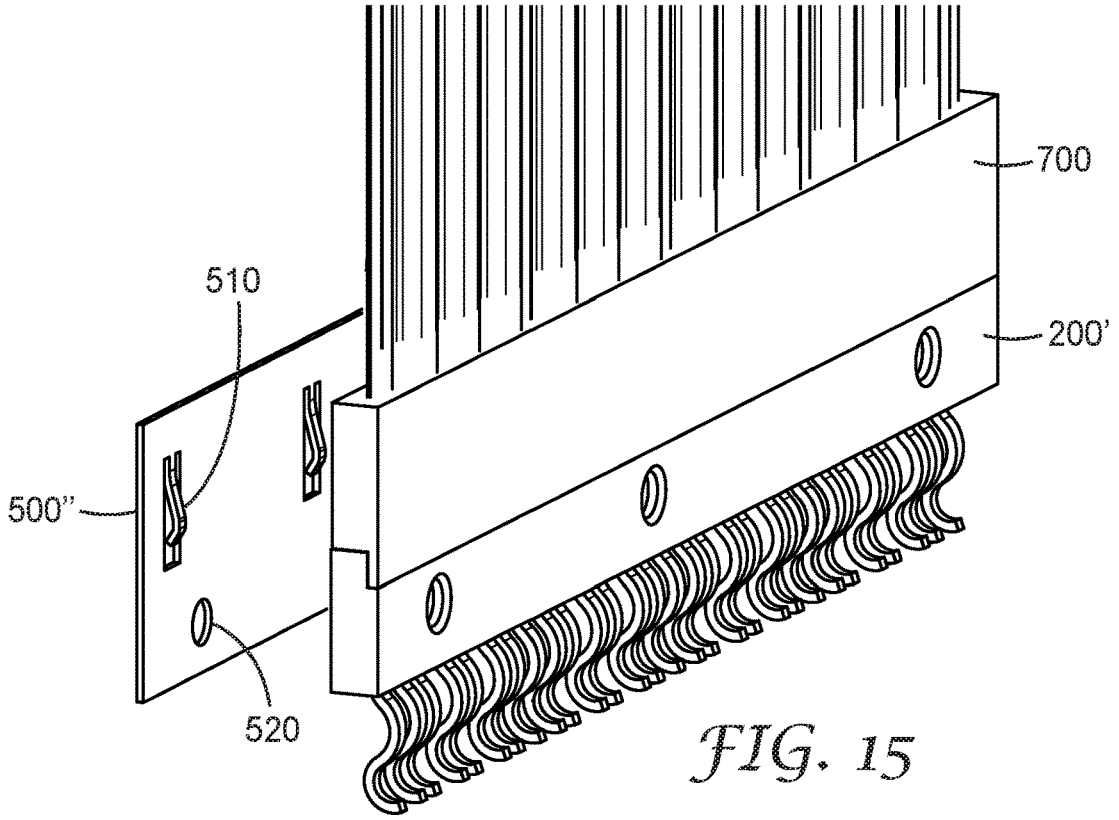
FIG. 15 is an exploded view of a wafer assembly in accordance with some embodiments.
Figure 16:
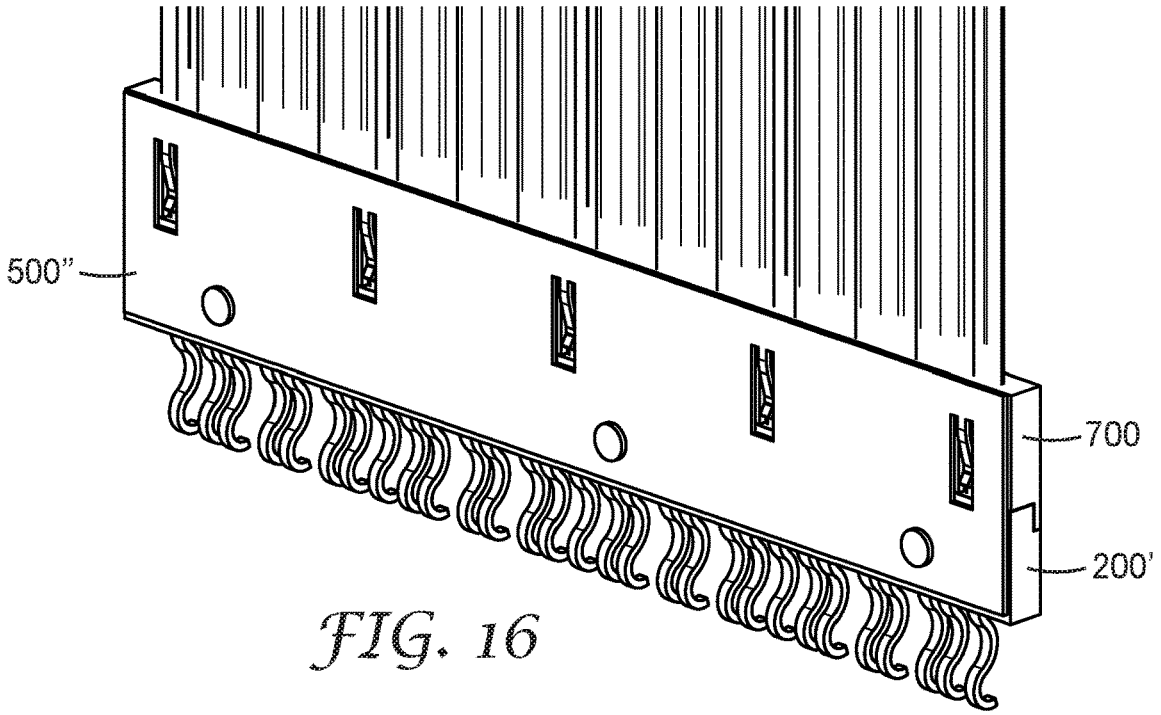
FIG. 16 shows the waver assembly of FIG. 15 with the shield attached.

Referring now to FIG. 15, in some embodiments, the shield 500" is disposed between the pair of adjacent wafers 200' and defines at least one through opening 520 in the shield 500". At least one first 230 and second 235 locking features (see FIGS. 11 and 12) of the pair of adjacent wafers 200 engage each other through the at least one through opening 520 of the shield 500".

Figure 13:
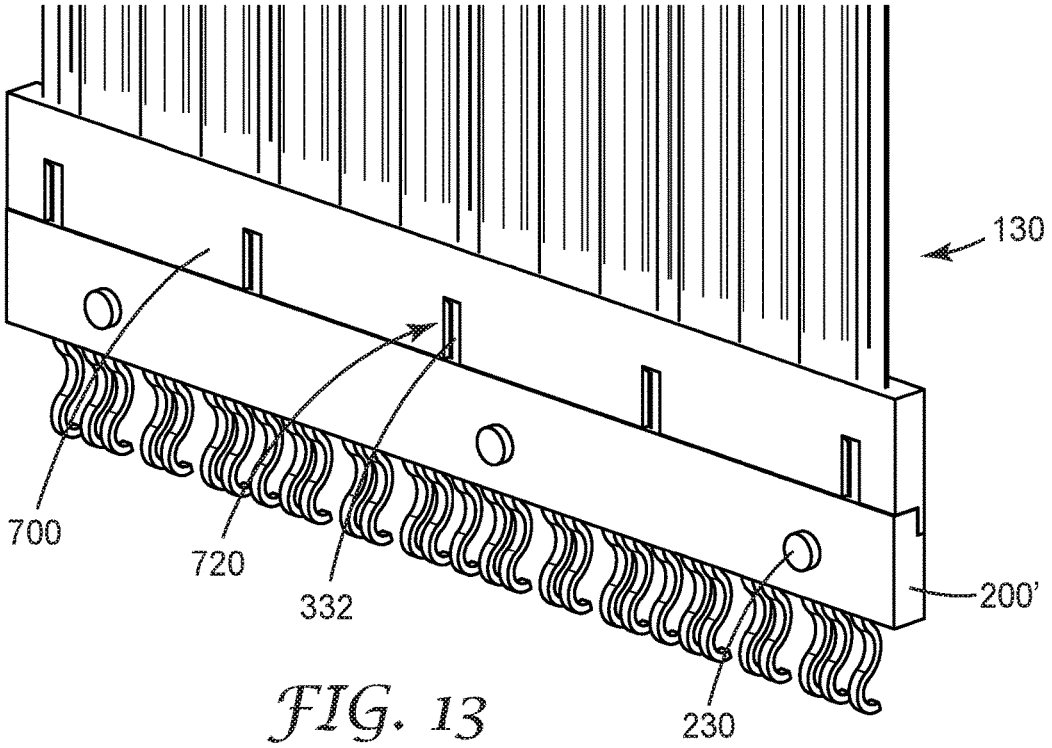
FIG. 13 is a perspective view of a wafer assembly that includes an inner mold in accordance with some embodiments.
Figure 14:
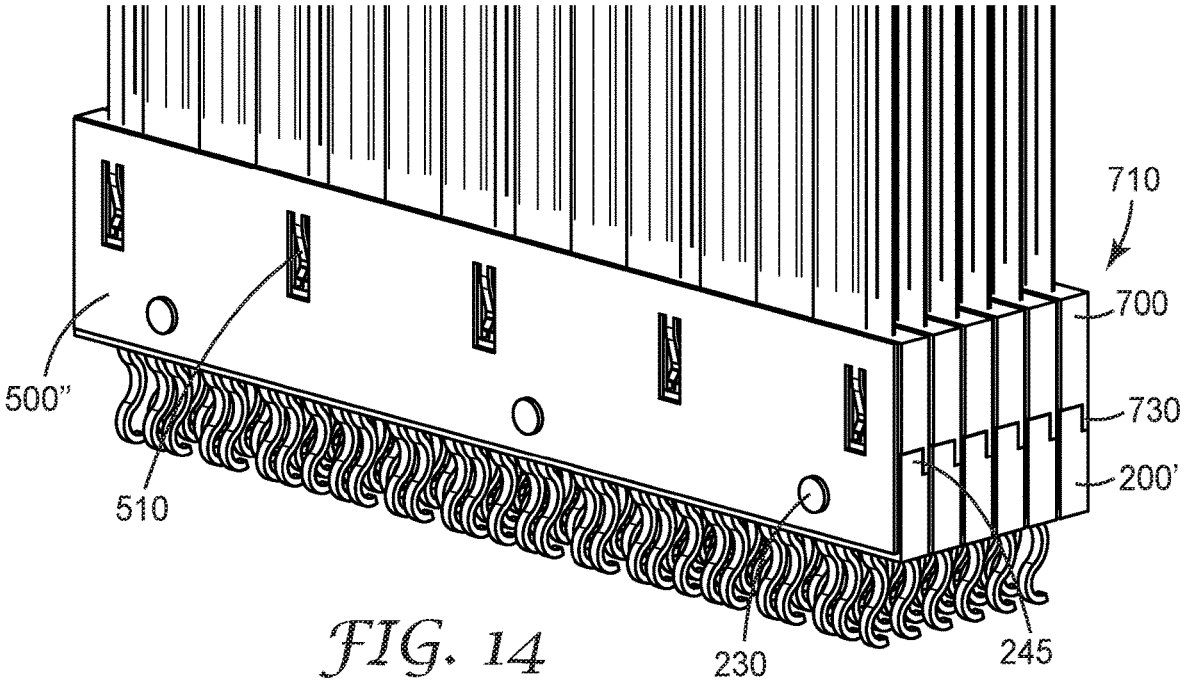
FIG. 14 shows a stack of wafer assemblies that include the inner mold shown in FIG. 13.

As depicted in FIGS. 13 and 14, each wafer assembly 130 may include an inner mold 700 molded over and enclosing the termination regions 410 of the plurality of wires 400, such that in the stack of wafer assemblies 130, the inner molds 700 form a stack 710 of inner molds 700. The inner mold 700 of each wafer assembly 130 may define at least one opening 720 that exposes a portion 332 of the contact portion 330 of a corresponding terminal 300. The shield 500" of the wafer assembly 130 extends across and covers the inner mold 700 and physically contacts the exposed portion 332 of the contact portion 330 through the at least one opening 720. According to some implementations, the shield 500" comprises at least one flexible tab 510 bent toward the inner mold 700. The flexible tab 510 is inserted in the opening 720 of the inner mold 700 and makes physical contact with the exposed portion 332 of the contact portion 330. As shown in FIGS. 13 and 14, in some implementations, the inner mold 700 and the wafer 200' of each wafer assembly 130 are adjacent to one another. The inner mold 700 includes a first engaging feature 730 engaging a corresponding second engaging feature 245 of the wafer 200'. For example the first engaging feature 730 may be a protrusion of the inner mold 700 that fits within a recess in the wafer 200'.

Referring again to FIG. 1, a housing 600 encloses at least the stacked wafers 200 and the termination regions 410 of the plurality of wires 400. For example, the housing 600 may be molded over at least the stacked wafers 200 and the termination regions 410.

Figure 8:
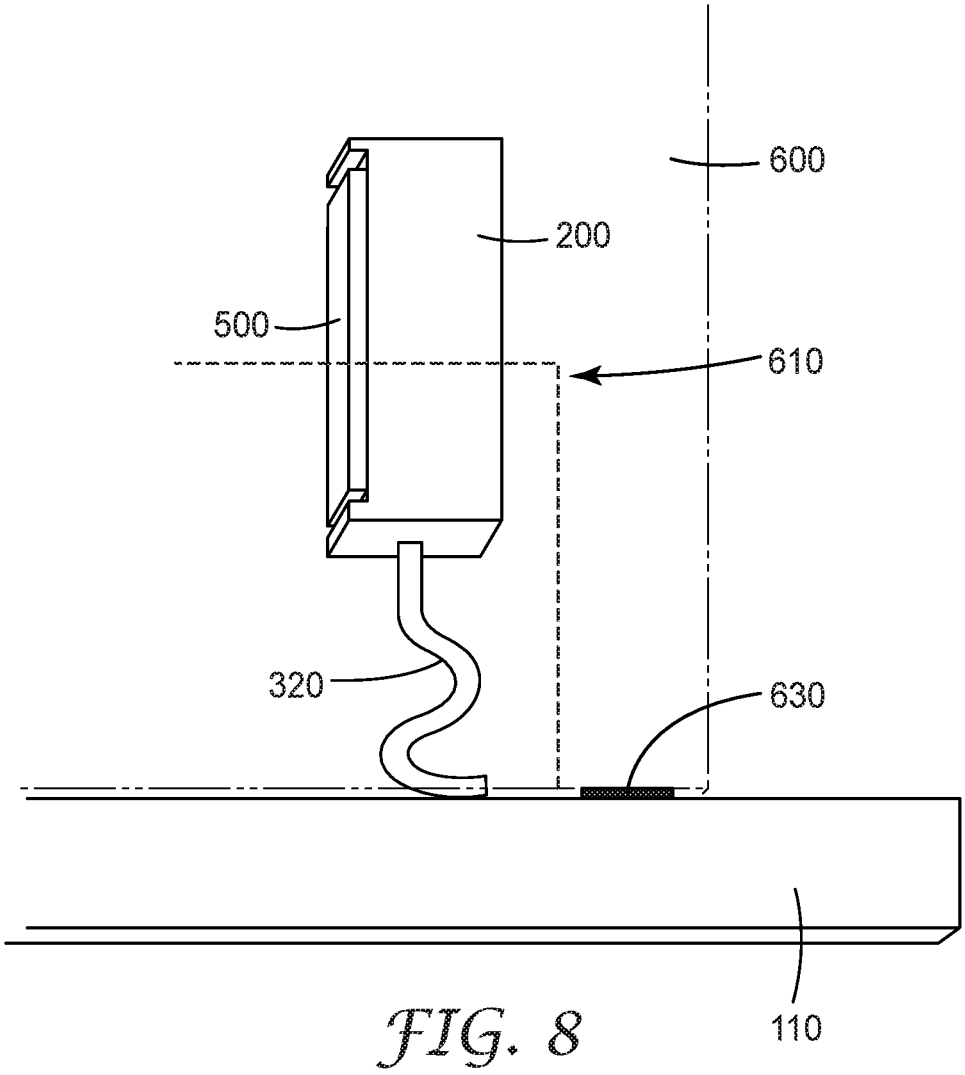
FIG. 8 depicts a perspective view of a mating portion of a terminal in accordance with some embodiments.
Figure 9:
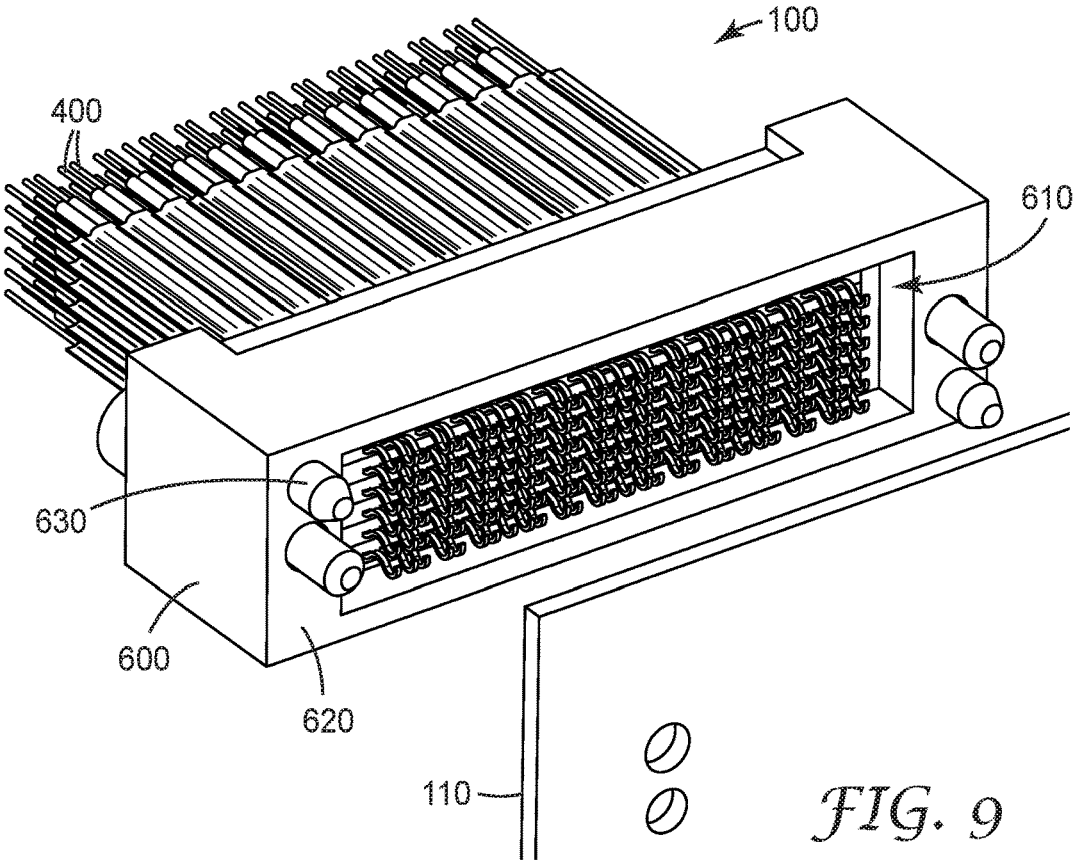
FIG. 9 shows a bottom perspective view of a connector assembly in accordance with some embodiments.

When the connector assembly 100 is mounted on a PCB 110 (see FIGS. 1, 2, and 8), each mating portion 320 is resiliently compressed in the mounting direction. According to some embodiments, as shown in FIG. 8, the housing 600 includes a stop that prevents a further compression of the mating portions 320 in the mounting direction. For example, in some implementations, the stop is the bottom surface 620 of the housing 600 or is disposed on the bottom surface 620 of the housing 600. In some implementations, the stop may be a protrusion that extends from bottom surface 620 of the housing 600. Referring to FIGS. 8 and 9, the mating portions 320 may be resiliently compressed inside a recess 610 defined in a bottom surface 620 of the housing 600.

As shown in FIG. 3, according to some embodiments, the housing 600 comprises aligning features 630 configured to align the mating portions 320 with corresponding conductive pads 112 of a PCB 110 as shown in FIG. 2. For example, as illustrated by FIG. 3, the aligning features 630 may comprise at least a pair of spaced apart protrusions configured to be inserted into corresponding recesses 114 of the PCB 110.

The housing 600 may include attaching features configured to attach and secure the connector assembly to a PCB 110. For example, the attaching features may comprise at least a pair of screws 640 inserted into corresponding holes 650 of the housing 600 from a top side 660 of the housing 600. When the connector assembly 100 is mounted on and pressed against a PCB 110 along the mounting direction and the mating portions 320 of the terminals 300 make solderless contact with corresponding conductive pads 112 of the PCB 110 and are resiliently compressed along the mounting direction, the pair of screws 640 are further inserted into corresponding holes 116 of the PCB from a top side 118 of the PCB 110 and attach the connector assembly 100 to the PCB 110. Attaching the connector assembly 100 to the PCB 110 prevents expansion of the compressed mating portions 320. As shown in FIG. 3, the attaching features may also include a pair of nuts 645. When the connector assembly is mounted on and pressed against a PCB 110 along the mounting direction, the screws 640 engage the nuts 645 from a bottom side 119 of the circuit board 110.

Figure 17A:
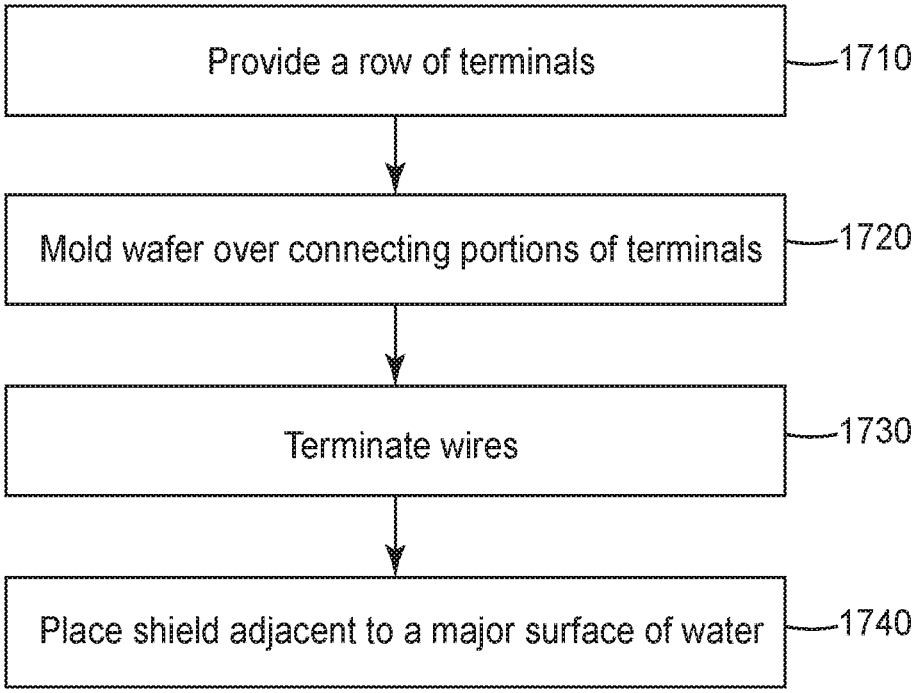
FIG. 17A is a flow diagram of a method of making a wafer assembly in accordance with some embodiments.
Figure 17B:
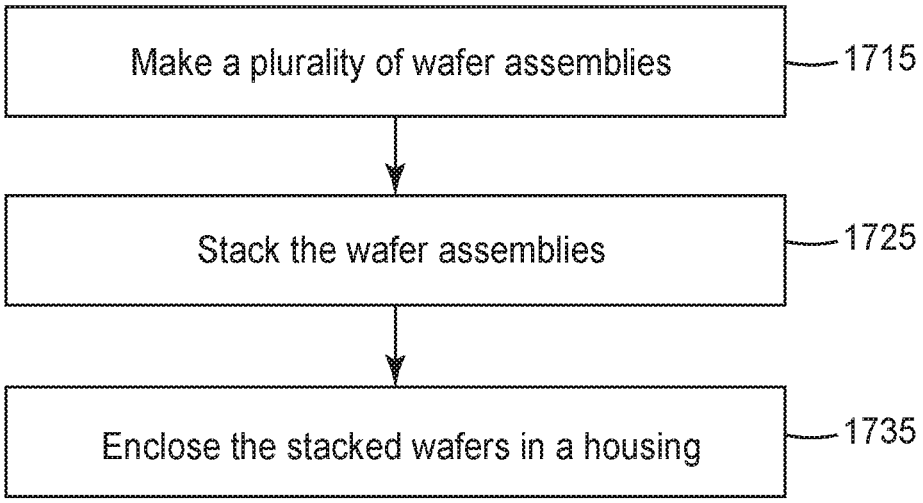
FIG. 17B is a flow diagram illustrating a method of making a connector assembly in accordance with some embodiments.

FIG. 17A is a flow diagram of a method of making a wafer assembly 130. FIG. 17B is a flow diagram of a method of making a connector assembly 100 for mounting on and making solderless electrical contact with a circuit board 110 along a mounting direction (z).

As depicted in FIG. 17A, making a wafer assembly includes providing 1710 a row of spaced apart substantially parallel terminals. Each terminal includes a connecting portion, a mating portion, and a contact portion. The mating portion extends from a first end of the connecting portion along the mounting direction for making solderless contact with a corresponding conductive pad of the PCB. The mating portion is resiliently compressible in the mounting direction. The contact portion extends from an opposite second end of the connecting portion along the mounting direction. A wafer is molded 1720 over the connecting portions of the plurality of terminals. The wafer has a width (W) along the mounting direction and a length (L) along the row direction (x) of the terminals. A plurality of wires is terminated 1730 in a termination region at the contact portion of a corresponding terminal. A shield is disposed 1740 adjacent a major surface of the wafer. The shield extends substantially along the entire width and length of the wafer.

A method of making a connector assembly (shown in FIG. 17B) includes making 1715 a plurality of wafer assemblies. The wafer assemblies may be made as previously discussed in connection with FIG. 17A. The wafer assemblies are stacked 1725 to form stacked wafers so that for each pair of adjacent wafers, the shield corresponding to one of the wafers is disposed between the wafers. At least the stacked wafers and the termination regions of the plurality of wires are enclosed 1735 in a housing. For example, enclosing the stacked wafers and termination regions may involve molding the housing over at least the stacked wafers and the termination regions of the plurality of wires. In some embodiments, an inner mold is molded over the termination regions of the plurality of wires. The inner mold defines at least one opening exposing a portion of the contact portion of a corresponding terminal. The shield of the wafer assembly extends across and covers the inner mold and physically contacts the exposed portion of the contact portion through the at least one opening.

Embodiments disclosed herein include:

Embodiment 1. A connector assembly for mounting on and making solderless electrical contact with a printed circuit board (PCB) along a mounting direction, comprising:

- a stack of wafer assemblies, each wafer assembly comprising:
  - a row of spaced apart substantially parallel terminals, each terminal comprising:
    - a connecting portion;
    - a mating portion extending from a first end of the connecting portion along the mounting direction for making solderless contact with a corresponding conductive pad of a PCB the mating portion resiliently compressible in the mounting direction; and
    - a contact portion extending from an opposite second end of the connecting portion along the mounting direction;
  - a wafer molded over and enclosing the connecting portions of the row of terminals, the wafer having a width along the mounting direction and a length along the row direction of terminals;
  - a plurality of wires, each wire terminated in a termination region at the contact portion of a corresponding terminal; and
  - a shield disposed adjacent a major surface of the wafer and extending substantially along the entire width and length of the wafer, the wafers in the stack of wafer assemblies stacked so that for each pair of adjacent wafers, the shield corresponding to one of the wafers is disposed between the wafers; and
- a housing enclosing at least the stacked wafers and the termination regions of the plurality of wires.

Embodiment 2. The connector assembly of embodiment 1 mounted on a PCB, each mating portion resiliently compressed in the mounting direction, a stop of the housing preventing a further compression of the mating portions in the mounting direction.

Embodiment 3. The connector assembly of embodiment 2, wherein the stop is a bottom surface of the housing.

Embodiment 4. The connector assembly of embodiment 2, wherein the mating portions are resiliently compressed inside a recess defined in a bottom surface of the housing.

Embodiment 5. The connector assembly of any of embodiments 1 through 4, wherein each wafer has a thickness along a thickness direction perpendicular to the row and mounting directions, the thickness substantially less than the width, and the width substantially less than the length.

Embodiment 6. The connector assembly of any of embodiments 1 through 5, wherein at least a portion of the mating portion of each terminal is s-shaped.

Embodiment 7. The connector assembly of any of embodiments 1 through 6, wherein the contact portion of each terminal defines a groove for receiving an end of a corresponding wire.

Embodiment 8. The connector assembly of any of embodiments 1 through 7, wherein the shield of each wafer assembly is a rectangular plate.

Embodiment 9. The connector assembly of any of embodiments 1 through 8, wherein for at least one wafer assembly, the shield extends beyond the wafer toward the termination region so that in a plan view, the shield covers at least a portion of the termination region.

Embodiment 10. The connector assembly of any of embodiments 1 through 9, wherein the housing comprises aligning means for aligning the mating portions with corresponding conductive pads of a PCB.

Embodiment 11. The connector assembly of embodiment 10, wherein the aligning means comprises at least a pair of spaced apart protrusions configured to be inserted into corresponding recesses of the PCB.

Embodiment 12. The connector assembly of any of embodiments 1 through 11, wherein the housing comprises attaching means for attaching and securing the connector assembly to a PCB.

Embodiment 13. The connector assembly of embodiment 12, wherein the attaching means comprises at least a pair of screws inserted into corresponding holes of the housing from a top side of the housing, such that when the connector assembly is mounted on and pressed against a PCB along the mounting direction and the mating portions of the terminals make solderless contact with corresponding conductive pads of the PCB and are resiliently compressed along the mounting direction, the pair of screws are further inserted into corresponding holes of the PCB from a top side of the PCB and attach the connector assembly to the PCB, the attaching preventing expansion of the compressed mating portions.

Embodiment 14. The connector assembly of embodiment 13, wherein the attaching means further comprises a pair of nuts, such that when the connector assembly is mounted on and pressed against a PCB along the mounting direction, the screws engage the nuts from a bottom side of the circuit board.

Embodiment 15. The connector assembly of any of embodiments 1 through 14, wherein for each wafer assembly, the wafer defines a recess in a major surface of the wafer and the shield is disposed in the recess.

Embodiment 16. The connector assembly of any of embodiments 1 through 15, wherein the housing is molded over and encloses at least the stacked wafers and the termination regions of the plurality of wires.

Embodiment 17. The connector assembly of any of embodiments 1 through 16, wherein each wafer comprises at least one first locking feature on a first major surface of the wafer and at least one second locking feature on an opposite second major surface of the wafer, such that for each pair of adjacent wafers in the stacked wafers, the at least one first locking feature of one of the wafers engages the at least one second locking feature of the other one of the wafers to secure the wafers to one another.

Embodiment 18. The connector assembly of embodiment 17, wherein each first locking feature is a protrusion and each second locking feature is a recess.

Embodiment 19. The connector assembly of embodiment 18, wherein the shield disposed between the pair of adjacent wafers defines at least one through opening therein, the at least one first and second locking features of the pair of adjacent wafers engaging each other through the at least one through opening of the shield.

Embodiment 20. The connector assembly of any of embodiments 1 through 19, wherein each wafer assembly further comprises an inner mold molded over and enclosing the termination regions of the plurality of wires, such that in the stack of wafer assemblies, the inner molds form a stack of inner molds.

Embodiment 21. The connector assembly of embodiment 20, wherein the inner mold of each wafer assembly defines at least one opening exposing a portion of the contact portion of a corresponding terminal, and wherein the shield of the wafer assembly extends across and covers the inner mold and physically contacts the exposed portion of the contact portion through the at least one opening.

Embodiment 22. The connector assembly of embodiment 21, wherein the shield comprises at least one flexible tab bent toward the inner mold, the at least one flexible tab inserted in the at least one opening of the inner mold and making physical contact with the exposed portion of the contact portion.

Embodiment 23. The connector assembly of embodiment 20, wherein the inner mold and the wafer of each wafer assembly are adjacent to one another, the inner mold having a first engaging feature engaging a corresponding second engaging feature of the wafer.

Embodiment 24. The connector assembly of any of embodiments 1 through 23, wherein for each wafer assembly, the wafer is further molded over and encloses the termination regions of the plurality of wires.

Embodiment 25. A method of making a connector assembly for mounting on and making solderless electrical contact with a printed circuit board (PCB) along a mounting direction, the method comprising the steps of:

(a) making a wafer assembly comprising the steps of:

(i) providing a row of spaced apart substantially parallel terminals, each terminal comprising:

a connecting portion;

a mating portion extending from a first end of the connecting portion along the mounting direction for making solderless contact with a corresponding conductive pad of a PCB, the mating portion resiliently compressible in the mounting direction; and a contact portion extending from an opposite second end of the connecting portion along the mounting direction;

(ii) molding a wafer over the connecting portions of the plurality of the terminals, the wafer having a width along the mounting direction and a length along the row direction of the terminals;

(iii) providing a plurality of wires and terminating each wire in a termination region at the contact portion of a corresponding terminal; and (iv) disposing a shield adjacent a major surface of the wafer, the shield extending substantially along the entire width and length of the wafer;

(b) repeating step (a) at least once to form a plurality of wafer assemblies;

(c) stacking the wafers in the plurality of wafer assemblies to form a stacked wafers so that for each pair of adjacent wafers, the shield corresponding to one of the wafers is disposed between the wafers; and (d) enclosing at least the stacked wafers and the termination regions of the plurality of wires in a housing.

Embodiment 26. The method of embodiment 25, wherein in step (iii), the termination of the plurality of wires at the contact portions of the terminals is carried out substantially simultaneously.

Embodiment 27. The method of any of embodiments 25 through 26, wherein in step (d) the housing is molded over at least the stacked wafers and the termination regions of the plurality of wires.

Embodiment 28. The method of any of embodiments 25 through 27 further comprising the step of molding an inner mold over the termination regions of the plurality of wires, wherein the inner mold defines at least one opening exposing a portion of the contact portion of a corresponding terminal, and wherein the shield of the wafer assembly extends across and covers the inner mold and physically contacts the exposed portion of the contact portion through the at least one opening.

Unless otherwise indicated, all numbers expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein. The use of numerical ranges by endpoints includes all numbers within that range (e.g. 1 to 5 includes 1, 1.5, 2, 2.75, 3, 3.80, 4, and 5) and any range within that range.

Various modifications and alterations of these embodiments will be apparent to those skilled in the art and it should be understood that this scope of this disclosure is not limited to the illustrative embodiments set forth herein. For example, the reader should assume that features of one disclosed embodiment can also be applied to all other disclosed embodiments unless otherwise indicated.

The invention claimed is:

1. A connector assembly for mounting on and making solderless electrical contact with a printed circuit board (PCB) along a mounting direction, comprising:

a stack of wafer assemblies, each wafer assembly comprising:

a row of spaced apart substantially parallel terminals, each terminal comprising:

a connecting portion;

a mating portion extending from a first end of the connecting portion along the mounting direction for making solderless contact with a corresponding conductive pad of a PCB the mating portion resiliently compressible in the mounting direction; and a contact portion extending from an opposite second end of the connecting portion along the mounting direction;

a wafer molded over and enclosing the connecting portions of the row of terminals, the wafer having a width along the mounting direction and a length along the row direction of terminals, wherein the wafer includes a first locking feature and a second locking feature, the first locking feature configured to engage with the second locking feature on an adjacent wafer, and the first locking feature and the second locking feature are coaxial;

a plurality of wires, each wire terminated in a termination region at the contact portion of a corresponding terminal; and a shield disposed adjacent a major surface of the wafer and extending substantially along the entire width and length of the wafer, the wafers in the stack of wafer assemblies stacked so that for each pair of adjacent wafers, the shield corresponding to one of the wafers is disposed between the wafers; and a housing enclosing at least the stacked wafers and the termination regions of the plurality of wires.

2. The connector assembly of claim 1 mounted on a PCB, each mating portion resiliently compressed in the mounting direction, a stop of the housing preventing a further compression of the mating portions in the mounting direction, wherein the mating portions are resiliently compressed inside a recess defined in a bottom surface of the housing, and wherein the stop is a protrusion that extends from a bottom surface of the housing.

3. The connector assembly of claim 1, wherein at least a portion of the mating portion of each terminal is s-shaped.

4. The connector assembly of claim 1, wherein the contact portion of each terminal defines a groove for receiving an end of a corresponding wire.

5. The connector assembly of claim 1, wherein for at least one wafer assembly, the shield extends beyond the wafer toward the termination region so that in a plan view, the shield covers at least a portion of the termination region.

6. The connector assembly of claim 1, wherein the housing comprises attaching means for attaching and securing the connector assembly to a PCB, wherein the attaching means comprises at least a pair of screws inserted into corresponding holes of the housing from a top side of the housing, such that when the connector assembly is mounted on and pressed against a PCB along the mounting direction and the mating portions of the terminals make solderless contact with corresponding conductive pads of the PCB and are resiliently compressed along the mounting direction, the pair of screws are further inserted into corresponding holes of the PCB from a top side of the PCB and attach the connector assembly to the PCB, the attaching preventing expansion of the compressed mating portions.

7. The connector assembly of claim 1, wherein for each wafer assembly, the wafer defines a recess in a major surface of the wafer and the shield is disposed in the recess.

8. The connector assembly of claim 1, wherein the housing is molded over and encloses at least the stacked wafers and the termination regions of the plurality of wires.

9. The connector assembly of claim 1, wherein each wafer comprises at least one first locking feature on a first major surface of the wafer and at least one second locking feature on an opposite second major surface of the wafer, such that for each pair of adjacent wafers in the stacked wafers, the at least one first locking feature of one of the wafers engages the at least one second locking feature of the other one of the wafers to secure the wafers to one another.

10. The connector assembly of claim 9, wherein each first locking feature is a protrusion and each second locking feature is a recess.

11. The connector assembly of claim 10, wherein the shield disposed between the pair of adjacent wafers defines at least one through opening therein, the at least one first and second locking features of the pair of adjacent wafers engaging each other through the at least one through opening of the shield.

12. The connector assembly of claim 1, wherein each wafer assembly further comprises an inner mold molded over and enclosing the termination regions of the plurality of wires, such that in the stack of wafer assemblies, the inner molds form a stack of inner molds.

13. The connector assembly of claim 12, wherein the inner mold of each wafer assembly defines at least one opening exposing a portion of the contact portion of a corresponding terminal, and wherein the shield of the wafer assembly extends across and covers the inner mold and physically contacts the exposed portion of the contact portion through the at least one opening.

14. The connector assembly of claim 13, wherein the shield comprises at least one flexible tab bent toward the inner mold, the at least one flexible tab inserted in the at least one opening of the inner mold and making physical contact with the exposed portion of the contact portion.

15. The connector assembly of claim 12, wherein the inner mold and the wafer of each wafer assembly are adjacent to one another, the inner mold having a first engaging feature engaging a corresponding second engaging feature of the wafer.

16. The connector assembly of claim 1, wherein for each wafer assembly, the wafer is further molded over and encloses the termination regions of the plurality of wires.

17. A method of making a connector assembly for mounting on and making solderless electrical contact with a printed circuit board (PCB) along a mounting direction, the method comprising the steps of:

(a) making a wafer assembly comprising the steps of:

(i) providing a row of spaced apart substantially parallel terminals, each terminal comprising:

a connecting portion;

a mating portion extending from a first end of the connecting portion along the mounting direction for making solderless contact with a corresponding conductive pad of a PCB, the mating portion resiliently compressible in the mounting direction; and a contact portion extending from an opposite second end of the connecting portion along the mounting direction;

(ii) molding a wafer over the connecting portions of the plurality of the terminals, the wafer having a width along the mounting direction and a length along the row direction of the terminals and having a first locking feature and a second locking feature, the first locking feature configured to engage with the second locking feature on an adjacent wafer, and the first locking feature and the second locking feature being coaxial;

(iii) providing a plurality of wires and terminating each wire in a termination region at the contact portion of a corresponding terminal; and (iv) disposing a shield adjacent a major surface of the wafer, the shield extending substantially along the entire width and length of the wafer;

(b) repeating step (a) at least once to form a plurality of wafer assemblies;

(c) stacking the wafers in the plurality of wafer assemblies to form a stacked wafers so that for each pair of adjacent wafers, the shield corresponding to one of the wafers is disposed between the wafers;

(d) enclosing at least the stacked wafers and the termination regions of the plurality of wires in a housing, and (e) molding an inner mold over the termination regions of the plurality of wires, wherein the inner mold defines at least one opening exposing a portion of the contact portion of a corresponding terminal, and wherein the shield of the wafer assembly extends across and covers the inner mold and physically contacts the exposed portion of the contact portion through the at least one opening.

18. The method of claim 17, wherein in step (iii), the termination of the plurality of wires at the contact portions of the terminals is carried out substantially simultaneously.

19. The method of claim 17, wherein in step (d) the housing is molded over at least the stacked wafers and the termination regions of the plurality of wires.

* * * * *